United States Patent [19]

Wehrmeister

[11] 4,177,765

[45] Dec. 11, 1979

[54] OUTPUT CONTROL FOR FLUIDIZED BED BOILERS

[75] Inventor: Allen E. Wehrmeister, Lynchburg, Va.

[73] Assignee: The Babcock & Wilcox Co., New York, N.Y.

[21] Appl. No.: 933,299

[22] Filed: Aug. 14, 1978

[51] Int. Cl.[2] ..... F22B 1/02; F23D 19/02

[52] U.S. Cl. ..... 122/4 D; 110/263

[58] Field of Search ..... 122/4 D; 110/245, 263; 165/104 F

[56] References Cited

U.S. PATENT DOCUMENTS

| | | | |
|---|---|---|---|
| 2,997,286 | 8/1961 | Friese | 122/4 |
| 3,893,426 | 7/1975 | Bryers | 110/245 |
| 4,096,909 | 6/1978 | Jukkola | 122/4 |
| 4,136,642 | 1/1979 | Novotny et al. | 110/263 |

*Primary Examiner*—Kenneth W. Sprague

*Attorney, Agent, or Firm*—J. M. Maguire; E. A. Steen; S. R. Doody

[57] ABSTRACT

A fluidized bed boiler is equipped with a plurality of slidable sleeves circumscribing the vapor generator tubes disposed therein. By selectively extending or retracting the sleeves over the tubes, the heat transfer characteristics of the tubes exposed to the heat generated within the boiler may be altered. As a consequence, steam output quantity and quality may be easily modulated. In addition, by virtue of the design, tube cleaning may be accomplished with each adjustment pass.

8 Claims, 4 Drawing Figures

OUTPUT CONTROL FOR FLUIDIZED BED BOILERS

TECHNICAL FIELD

This invention relates to fluidized bed boilers in general and more specifically to an apparatus for regulating the quantity and quality of the fluid heated therein.

BACKGROUND ART

In recognition of their inherently cleaner and potentially more efficient fuel burning properties, fluidized bed boilers are now seriously being considered as viable supplements to the traditional pulverized coal and stoker fired vapor generating units of today.

Briefly, a fluidized bed boiler burns granulated coal in a floating fluid-like suspension called a fluidized bed. In addition to the coal, a sorbent (usually limestone) is introduced into the bed to absorb the noxious gases generated as a result of the burning process. By introducing fluidizing air from beneath the burning zone, the burning coal actually floats on a mobile cushion of air as it is consumed. By allowing the coal to float in suspension, fuel combustion is improved. As a result of the enhanced combustion process, greater quantities of heat may be produced. And, as a consequence of the introduction of the sorbent, undesirable pollution levels are substantially reduced.

During normal operations, it is expected that a fluidized bed boiler will experience large fluctuations in the load impressed upon it. During peak demand periods, the boiler will be called on to deliver increased amounts of steam. Conversely, during slack demand periods, decreased amounts of steam will be required.

It has been suggested that one possible method of steam quantity and/or steam temperature control may be to raise or lower the height of the bed. By altering the depth of the bed, the amount of steam generator tube surface submerged within the bed may be varied as well. However, by lowering the bed height, the newly exposed tubes disposed above the bed may have a deleterious effect upon the performance of the boiler. The exposed tubes may quench the gases leaving the bed and limit above bed burning. This will result in an increase in both unburned combustibles and pollution emissions.

Another frequently mentioned method of steam output control is to modulate the temperature of the bed itself. This method of control may be accomplished by either placing additional bed compartments into service or removing them from service (slumping) as conditions dictate. Furthermore, the quantity of fuel introduced into the bed may be regulated as well.

Unfortunately, all of the above enumerated methods present difficulties. It has been determined that to maintain acceptable combustion efficiency and emission levels, it may be necessary to operate the bed within a narrow temperature range irrespective of the load impressed upon the boiler. Thus, fluctuations in bed temperature and bed height may be undesirable.

Clearly, an alternate means for controlling steam output is necessary.

SUMMARY OF THE INVENTION

The disclosed invention attempts to surmount the above problems by physically altering the heat transfer characteristics of the steam generator tubes exposed to the heat generated within the fluidized bed.

Instead of varying the bed height and/or the bed temperature, regulated heat transfer is accomplished by engaging sliding insulated sleeves over the various steam generating tubes. By selectively extending and retracting the sleeves, the amount of exposed tubular surface may be regulated. This particular construction results in great control of both the quantity and quality of the steam ultimately produced.

BEST MODES FOR CARRYING OUT THE INVENTION

Figure 1:
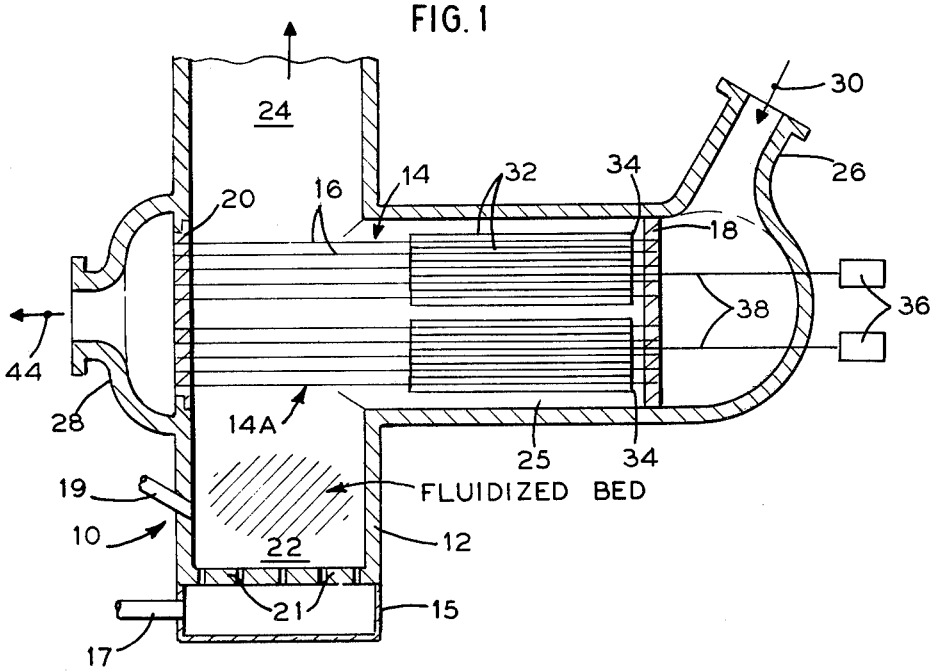
FIG. 1 is a sectional side view of a fluidized bed boiler embodying the invention.

FIG. 1 depicts a once through fluidized bed boiler 10 having furnace wall 12, tube banks 14 and 14A, windbox 15 and combustion chamber 22. Each bank is composed of a plurality of steam generator tubes 16. Tube sheets 18 and 20 support the tubes 16 in place.

A fuel-sorbent mixture is introduced into the chamber 22 through feed pipe 19. Fluidizing air enters the windbox 15 via air conduit 17. The air then travels upwardly through perforated distribution plate 21 to effect the fluidization of the fuel-sorbent mixture within the chamber 22.

The simultaneous combustion and fluidization of the fuel occurs within the chamber 22. Note that the tubes are shown above the bed for illustrative purposes only. It should be appreciated that the tubes may be oriented within the bed as well.

Note further that the tubes are located within the hot combustion chamber 22 and the relatively cooler furnace leg 25. The importance of this construction will become evident from the subsequent discussion.

Flue 24 permits the hot combustion gases generated within the chamber 22 to vent out of the boiler 10.

Feedwater enters the boiler through feedwater inlet nozzle 26. The feedwater then flows through the individual tubes 16 disposed within the tube banks 14 and 14A. The water is vaporized as it passes in indirect heat exchange with the hot combustion gases generated within the chamber 22. The steam then exits the boiler by passing through steam outlet nozzle 28. The paths taken by the water and steam as they pass through the boiler are shown by directional arrows 30 and 44, respectively.

Insulating sleeves 32 closely circumscribe each tube 16. In addition, each sleeve 32 is mounted upon a perforated mounting plate 34. The mounting plates are, in turn, connected to actuators 36 by means of members 38. The actuators 36 and members 38 slide the sleeves 32 over the tubes 16. In addition, the members 38 support the mounting plates 34 and the sleeves 32. Other expeditious designs for mounting and coordinating the travel of the actuators and the sleeves may be employed as well.

By selectively positioning the sleeves over the tubes, a furnace operator may adjust the tubular surface area exposed to the heat being generated within the boiler 10. As a consequence, both the steam temperature and the quantity of the steam produced may be regulated.

Furthermore, the sleeves serve an additional function within the boiler. During normal boiler operation, soot, ash and other combustion by-products may collect upon the surface of the tubes. Over a period of time, such deposits will slowly reduce the heat transfer capacities of the tubes. This undesirable state of affairs is further compounded by the fact that such deposits are generally corrosive in nature. Left unchecked, these deposits are likely to precipitate debilitating tube failure.

The sleeve-tube combination substantially reduces the above enumerated dangers. By virtue of the sliding action of each sleeve, the tubes are scraped clean every time the steam output is altered. In addition to the cleaning action engendered by each adjustment pass, intentional tube scraping may be effected by a periodic regimen of sleeve extensions and retractions.

Figure 2:
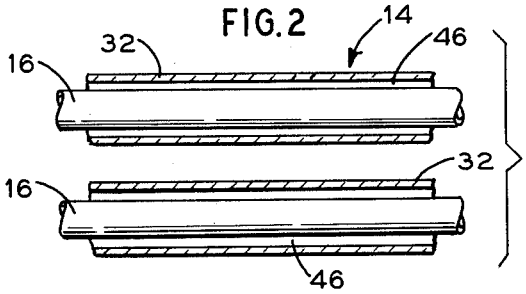
FIG. 2 is a detailed view embodying a feature of the invention.

FIG. 2 is a more detailed view of the individual tubes 16 closely circumscribed by the sleeves 32. Although the sleeves are shown independent from one another, it may be desirable to connect them together by employing a series of small spacers (not shown) disposed intermediate the sleeves.

Annular expansion space 46, disposed between the sleeves 32 and the tubes 16, allows the sleeves and tubes room to expand when they are subjected to the intense heat generated within the boiler 10. The actual spatial relationship between these components is governed by their respective thermal expansion rates. Although the fit between the two surfaces must be snug to effect the desired insulating and cleaning actions, sufficient expansion space must be provided between the inner surface of the sleeves and the outer surface of the tubes. Otherwise, undesirable binding may occur between the sleeves and tubes which will ultimately result in costly tube damage.

Figure 3:
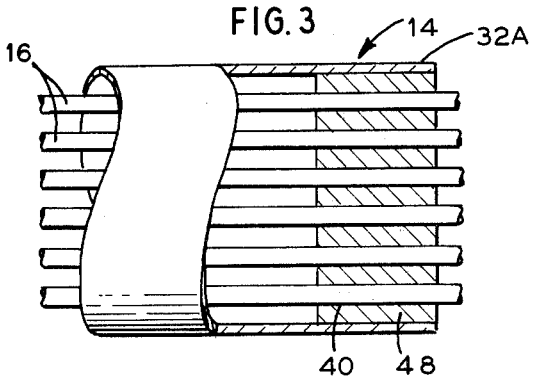
FIG. 3 is a detailed view of an alternate embodiment of the invention.

FIG. 3 depicts an alternate embodiment of the invention. Instead of employing one sleeve per tube, it may be advantageous to encircle a number of adjacent tubes within a single sleeve 32A. To accomplish the above mentioned cleaning action, a longitudinally perforated plug 48 may be inserted within the sleeve. The tubes, of course, are contiguously disposed within the perforations 40. As the sleeve 32A makes a pass over the tubes, the plug 48, by virtue of its orientation within the sleeve, will scrape the individual tube surfaces clean. Of course, it is possible to employ the sleeve 32A without the plug 48 as well. However, the tubes will not be cleaned.

Figure 4:
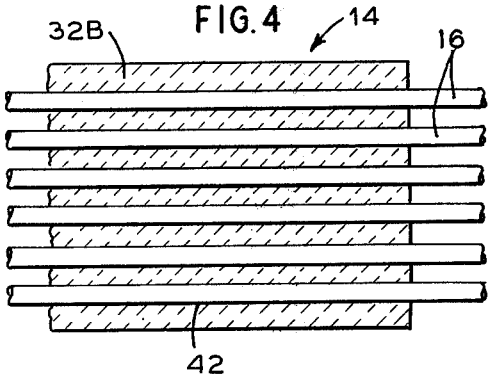
FIG. 4 is a detailed view of another alternate embodiment of the invention.

FIG. 4 discloses another alternate embodiment of the invention. Whereas the embodiment of the invention disclosed in FIG. 3 utilized hollow sleeves 32A, the embodiment depicted by FIG. 4 utilizes solid insulating sleeves 32B. Each sleeve 32B contains a plurality of longitudinally disposed perforations 42. It is contemplated that a suitable castable refractory material be utilized with this embodiment. For example, the KAOLITE refractory series manufactured by the assignee, may be employed to great advantage. (KAOLITE is a registered trademark of the Babcock & Wilcox Company). Of course, this material as well as other suitable insulating materials, may be satisfactorily employed with all of the enumerated embodiments. Furthermore, if circumstances dictate, steel and other metallic sleeves may be utilized to great advantage as well.

As was previously discussed, the relative thermal expansion rates of the various components must also be accounted for in the design of the embodiments disclosed in FIGS. 3 and 4.

Depending on the circumstances, it may be desirable to increase the number of actuators 36. By employing a greater number of actuators, members 38 and mounting plates 34, finer steam quantity and quality modulation will result.

The invention and the manner of applying it may, perhaps, be better understood by a brief discussion of the principles underlying the invention.

During boiler start-up, the sleeves should be fully extended over the tubes. Combustion in the fluidized bed would then be initiated and the boiler fired up to the requisite optimum design temperature. As necessary, the sleeves are then retracted into the leg 25, thereby exposing the water-filled tubes to the heat generated within the chamber 22.

Depending on the load and the number of mounting plates 34 employed, various sets of sleeves may be positioned in staggered positions within the bank. As the load increases, thereby necessitating greater steam output, more sleeves are retracted. Conversely, as the load decreases, resulting in decreased steam demand, more sleeves are extended over the tubes. By employing this invention one may exercise great control over the steam output while simultaneously maintaining both the fluidized bed height and the furnace temperature at their optimum design levels.

As mentioned previously, the entire surface of each tube will be cleaned after each sleeve adjustment pass. This reduces the need for expensive sootblowers since, by virtue of the scraping action, the loosened tube deposits will be drawn out of the boiler by the natural draft present within the boiler.

In addition, the sleeves serve in a protective role as well. During start-up periods, the tubes will be relatively "cold". To prevent undue tube strain engendered by the relatively rapid increase of heat within the generator, the fully extended sleeves will shield the tubes from the shock precipitated by the drastic temperature increases. By gradually withdrawing the sleeves, the tubes will progressively attain their operating temperature. This gradual temperature increase will prolong tube life. Conversely, during a boiler shutdown or turndown, the bed itself will retain great quantities of residual heat for an appreciable length of time. By fully extending the sleeves over the tubes during this period, the tubes will be forestalled from overheating.

It should be appreciated that although a once through fluidized bed boiler having steam generator tubes above the bed has been depicted for illustrative purposes, other fluidized bed designs may employ the invention as well. Furthermore, the location and the orientation of the tubes is of no moment since the sleeves and the attendant actuating mechanism will operate satisfactorily regardless of the ultimate positioning of the tubes.

While in accordance with the provisions of the statutes there is illustrated and described herein specific embodiments of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. In combination with a vapor generator having a combustion chamber fired by a fluidized bed of granular material, a multiplicity of heat exchanger tubes arranged within the generator to form at least one tube bank for heating fluids flowing therethrough, a heat shielding apparatus which comprises a plurality of slidable insulating sleeves, the sleeves circumscribing a portion of the length of the tubes, and means for supporting and sliding the sleeves over the exposed portion of the tubes to vary the amount of tubular surface area exposed to the heat generated within the chamber.

2. The combination according to claim 1 wherein each sleeve circumscribes a tube.

3. The combination according to claim 1 wherein each sleeve circumscribes a number of adjacent tubes.

4. The combination according to claim 3 wherein at least one longitudinally perforated plug is disposed within each sleeve.

5. The combination according to claim 4 wherein the tubes extend through the perforated plug to promote tube cleaning.

6. The combination according to claim 3 wherein each sleeve is solid and includes longitudinal perforations extending therethrough.

7. The combination according to claim 6 wherein the tubes are disposed within the perforations to promote tube cleaning.

8. The combination according to claim 1 wherein the sleeves are made from castable refractory material.

* * * * *